US008955454B2

(12) United States Patent
Kawahara et al.

(10) Patent No.: US 8,955,454 B2
(45) Date of Patent: Feb. 17, 2015

(54) ROWING BOAT FOOTREST ASSEMBLY

(75) Inventors: Yuji Kawahara, Osaka (JP); Masahiro Ohkoshi, Osaka (JP)

(73) Assignee: Shimano Inc., Osaka (JP)

( * ) Notice: Subject to any disclaimer, the term of this patent is extended or adjusted under 35 U.S.C. 154(b) by 1944 days.

(21) Appl. No.: 12/031,919

(22) Filed: Feb. 15, 2008

(65) Prior Publication Data

US 2009/0205556 A1 Aug. 20, 2009

(51) Int. Cl.

| | |
|---|---|
| ***B63B 17/00*** | (2006.01) |
| ***B63H 16/02*** | (2006.01) |
| *B63B 35/71* | (2006.01) |
| *B63B 35/73* | (2006.01) |

(52) U.S. Cl.

CPC ..... *B63H 16/02* (2013.01); *B63B 35/71* (2013.01); *B63B 35/73* (2013.01)

USPC ..... 114/363

(58) Field of Classification Search

USPC ..... 114/363; 440/101–110, 7; 297/423.39–423.46, 344.1; 482/73; 74/594.5

See application file for complete search history.

(56) References Cited

U.S. PATENT DOCUMENTS

| | | | | |
|---|---|---|---|---|
| 421,080 | A * | 2/1890 | Kerns | 114/363 |
| 5,367,976 | A | 11/1994 | Van Schaik | |
| 6,119,551 | A | 9/2000 | Ueda | |
| 6,745,643 | B2 * | 6/2004 | Lubanski | 74/594.6 |
| 6,925,908 | B2 | 8/2005 | Muraoka | |
| 6,939,186 | B1 * | 9/2005 | Kuckes | 440/104 |
| 7,552,695 | B1 * | 6/2009 | Matsueda et al. | 114/363 |
| 2006/0183385 | A1 | 8/2006 | Kaufer | |
| 2006/0292940 | A1 | 12/2006 | Ewans | |

FOREIGN PATENT DOCUMENTS

| | | |
|---|---|---|
| DE | 36860 | 9/1889 |
| DE | 1 275 904 B | 8/1968 |
| DE | 279 858 A1 | 6/1990 |
| DE | 9309887 U | 8/1993 |
| DE | 4324864 A1 | 1/1995 |

OTHER PUBLICATIONS

German Office Action of corresponding German Application No. 10 2009 021 498.4-22 dated Feb. 15, 2011.

* cited by examiner

*Primary Examiner* — Edwin Swinehart
(74) *Attorney, Agent, or Firm* — Global IP Counselors

(57) ABSTRACT

A rowing boat footrest assembly includes a stationary support member and a footrest member. The stationary support member is configured and arranged for coupling to a boat structure with a pivot axis extending through a portion of the stationary support member. The footrest member has a footrest surface coupled to the stationary support member for pivotal movement about the pivot axis. The footrest member is configured and arranged to support a shoe such that with the shoe positioned on the footrest surface the pivot axis extends laterally through the shoe between a sole of the shoe and an upper surface of the shoe.

18 Claims, 8 Drawing Sheets

ROWING BOAT FOOTREST ASSEMBLY

BACKGROUND OF THE INVENTION

1. Field of the Invention

This invention generally relates to a rowing boat footrest assembly. More specifically, the present invention relates to rowing boat footrest assembly that includes a pivotable footrest member.

2. Background Information

Rowing is becoming an increasingly more popular form of recreation. Moreover, rowing has become a very popular competitive sport for both amateurs and professionals. Whether rowing is for recreation or competition, the rowing industry is constantly improving the various components of rowing boats and equipment used by rowing enthusiasts. One component that has been extensively redesigned is the rowing boat footrest.

Traditionally, the footrest in a rowboat is an angled surface upon which a rower can brace his or her feet to provide increased power during the rowing process. Recently, footrests have been provided with simple shoe retaining straps or mechanisms that hold a rower's shoe against the surface of the footrest. However, there is a problem with such structures in that the rowers shoe and foot are fixed in place and cannot move or pivot with the motion of the rower during the rowing back and forth stroke.

In view of the above, it will be apparent to those skilled in the art from this disclosure that there exists a need for an improved footrest configuration that allows for movement of a rower's foot relative to a footrest. This invention addresses this need in the art as well as other needs, which will become apparent to those skilled in the art from this disclosure.

SUMMARY OF THE INVENTION

One object of the present invention is to provide a footrest assembly for a rowing boat with structure that allows the rower's foot to pivot during the rowing motions.

Another object of the present invention is to provide a footrest assembly that is easily adjusted to suit movements of a variety of rowers regardless of their size.

Still another object of the present invention is to provide a footrest assembly with structure that allows the feet of a rower to pivot about the thumb joint or ball of the foot.

The foregoing objects can basically be attained by providing a rowing boat footrest assembly with a stationary support member and a footrest member. Preferably, the stationary support member is configured and arranged for coupling to a boat structure with a pivot axis that extends through a portion of the stationary support member. The footrest member has a footrest surface coupled to the stationary support member for pivotal movement about the pivot axis. The footrest member is further configured and arranged to support a shoe such that with the shoe positioned on the footrest surface the pivot axis extends laterally through the shoe between a sole of the shoe and an upper surface of the shoe.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
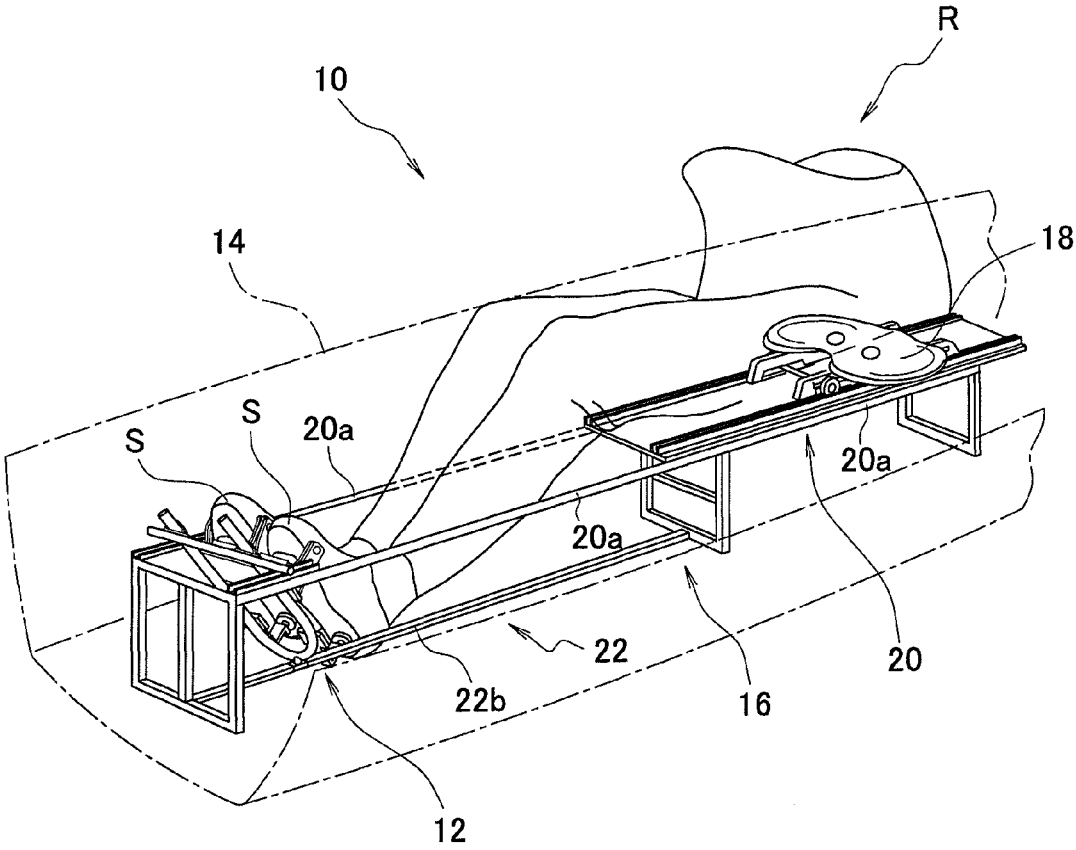
FIG. 1 is a perspective view showing a portion of a hull of a rowing boat showing a footrest assembly and a rower with shoes of the rower placed on a portion of the footrest assembly in a rowing position in accordance with the present invention.

Referring initially to FIG. 1, a rowing boat 10 that includes a footrest assembly 12 is illustrated in accordance with a first embodiment of the present invention.

A portion of the rowing boat 10 is depicted in FIG. 1. The rowing boat 10 can be any of a variety of boat where one or more persons is seated for rowing the boat. For example, the rowing boat 10 can be a sweep-oar rowing boat where each rower has one oar held by both hand, or the rowing boat 10 can be a sculling rowing boat where each rower has two oars, one oar held by each hand. The conventional oars of the rowing boat 10 are omitted for the sake of brevity and to provide greater clarity in the drawings. The rowing boat 10 includes a hull 14 (only a portion of the hull 14 is shown in FIG. 1), a support structure 16, a seat 18 and the footrest assembly 12.

The hull 14 can have any of a variety of conventional shapes and configurations depending upon whether the boat is a sweep-oar rowing boat or a sculling rowing boat. More specifically, the size and shape of the hull 14 can have any size and shape that can accommodate the footrest assembly 12. The support structure 16 is a conventional structure that is rigidly fixed to or rigidly supported to the interior of the hull 14 or gunwale portion of the hull 14. The support structure 16 includes a seat support portion 20 and a footrest assembly support portion 22.

It should be understood from the drawings and the description herein that the support structure 16 can be a single structure supported by and/or rigidly fixed to the hull 14, or alternatively can be two or more separated structures that are supported or rigidly fixed to the hull 14.

The seat support portion 20 includes parallel rails 20*a* disposed on either side of the hull 14 that support the seat 18. The seat 18 includes bearing portions such as rolling wheels or bushing surfaces that allow the seat 18 to slide smoothly fore and aft relative to the hull 14 along the parallel rails 20*a*.

The footrest assembly support portion 22 includes rails 22*a* and 22*b*. There are preferably two of the rails 22*a* arranged parallel to one another along the side of the hull 14. The rails 22*a* can be extensions of the parallel rails 20*a* or can be separate elements that extend in-line with or parallel to the parallel rails 20*a*. The rail 22*b* can be centered along the floor of the hull 14. In the depicted embodiment, the rail 22*b* is equidistant from the rails 22*a*, but is lower that the rails 22*a*.

When seated in the seat 18, a rower R can put his or her feet on the footrest assembly 12 and use the footrest assembly 12 as leverage to assist in rowing the rowing boat 10.

With specific reference to FIGS. 2-8, a description of the footrest assembly 12 is now provided. The footrest assembly 12 basically includes a first lateral support member 30, an inclined support member 32, a second lateral support member 34, a third support member 36, a pair of U-shaped footrest members 38 and a pair of shoe attachment portions 40.

The first lateral support member 30 extends laterally relative to the rowing boat 10 between sides of the hull 14. The first lateral support member 30 includes gripping blocks 50 that engage tracks 52 that are rigidly fixed on respective upper surfaces of the rails 22*a* of the footrest assembly support portion 22 of the support structure 16. The gripping blocks 50 and the tracks 52 include mating gear teeth configured such that the first lateral support member 30 can be selectively position along the rails 22*a*. For example, a taller rower may want the footrest assembly 12 moved to a forward position closer to the bow of the rowing boat 10. Shorter rower may want to move the footrest assembly 12 to a more rearward position toward the stern of the rowing boat 10.

Once positioned, the mating gear teeth of the gripping blocks 50 and the engage tracks 52 help to maintain the footrest assembly 12 in the selected position. Although not shown, the gripping blocks 50 can further include clamping elements or fasteners for selectively securing the gripping blocks 50 to the rails 22*a* once the footrest assembly 12 is positioned in the desired location.

The inclined support member 32 is a U-shaped member with two generally parallel portions that have upper ends 54. The upper ends 54 are fixedly attached to the first lateral support member 30 by clamping assemblies $C_1$ (shown in FIGS. 3-5). A lower end 56 of the inclined support member 32 includes a gripping block 58 similar to the gripping blocks 50. Further, the rail 22*b* includes a track 60 with gear teeth. As with the gripping blocks 50 of the first lateral support member 30, the gripping block 58 of the inclined support member 32 is engagable with the track 60 on the rail 22*b* for positioning the footrest assembly 12 relative to the support structure 16. Although not shown, the gripping block 58 can further include a clamping element or fastener for selectively securing the gripping blocks 58 to the rail 22*b* once the footrest assembly 12 is positioned in the desired location.

The inclined support member 32 further includes a pair of symmetrically arranged right and left side heel support members 64. Each of the heel support members 64 has an upper end 64*a* that is pivotally supported to the inclined support member 32, a shoe contacting surface 64*b* and an arcuate slot 64*c* with a fastener F extending therethrough into the inclined support member 32. The arcuate slot 64*c* and the fastener F are configured such that the position of the shoe contacting surface 64*b* can be adjusted with the heel support members 64 pivoting about a pivot point 64*d*. As is clear from FIGS. 2-5, the heel support members 64 are movable for position adjustment such that the heel support members 6 are preferably maintained parallel to a plane defined by the inclined support member 32.

It should be understood from the drawings and the description herein that although the inclined support member 32 has a U-shape, alternative shapes and configurations can be used for the inclined support member 32. For example, the inclined support member 32 can have a V-shape, or can be a flat member welded to or otherwise extending from the first lateral support member 30. Alternatively, the first lateral support member 30 and the inclined support member 32 can be formed as a single unitary element that has an overall planar configuration.

The second lateral support member 34 extends in a generally horizontal direction between portions of the inclined support member 32. The second lateral support member 34 is adjustably fixed to the inclined support member 32 by clamps $C_2$ shown in FIG. 3. Specifically, the position of the second lateral support member 34 can be adjusted to various positions up and down the inclined support member 32.

It should be understood from the drawings and the description herein, that the second lateral support member 34 is not limited to the depicted shape or dimensions. Specifically, the second lateral support member 34 can be adjustably positioned along the inclined support member 32 any of a variety of shaped elements that accomplish the same adjustment features of the depicted embodiment. More specifically, the second lateral support member 34 is adjustable along the inclined length of the inclined support member 32 regardless of the size, shape and overall structure of the inclined support member 32. In an alternative embodiment, the second lateral support member 34 can be non-movably and rigidly fixed to the inclined support member 32 or can be formed as a part of the inclined support member 32.

The U-shaped footrest members 38 and the shoe attachment portions 40 are all generally the same except that they can be symmetrically configured such that there is one of each for a left shoe and one of each for a right shoe. For the sake of brevity, only one of each of the U-shaped footrest members 38 and the shoe attachment portions 40 is described, the description applying to both.

Figure 2:
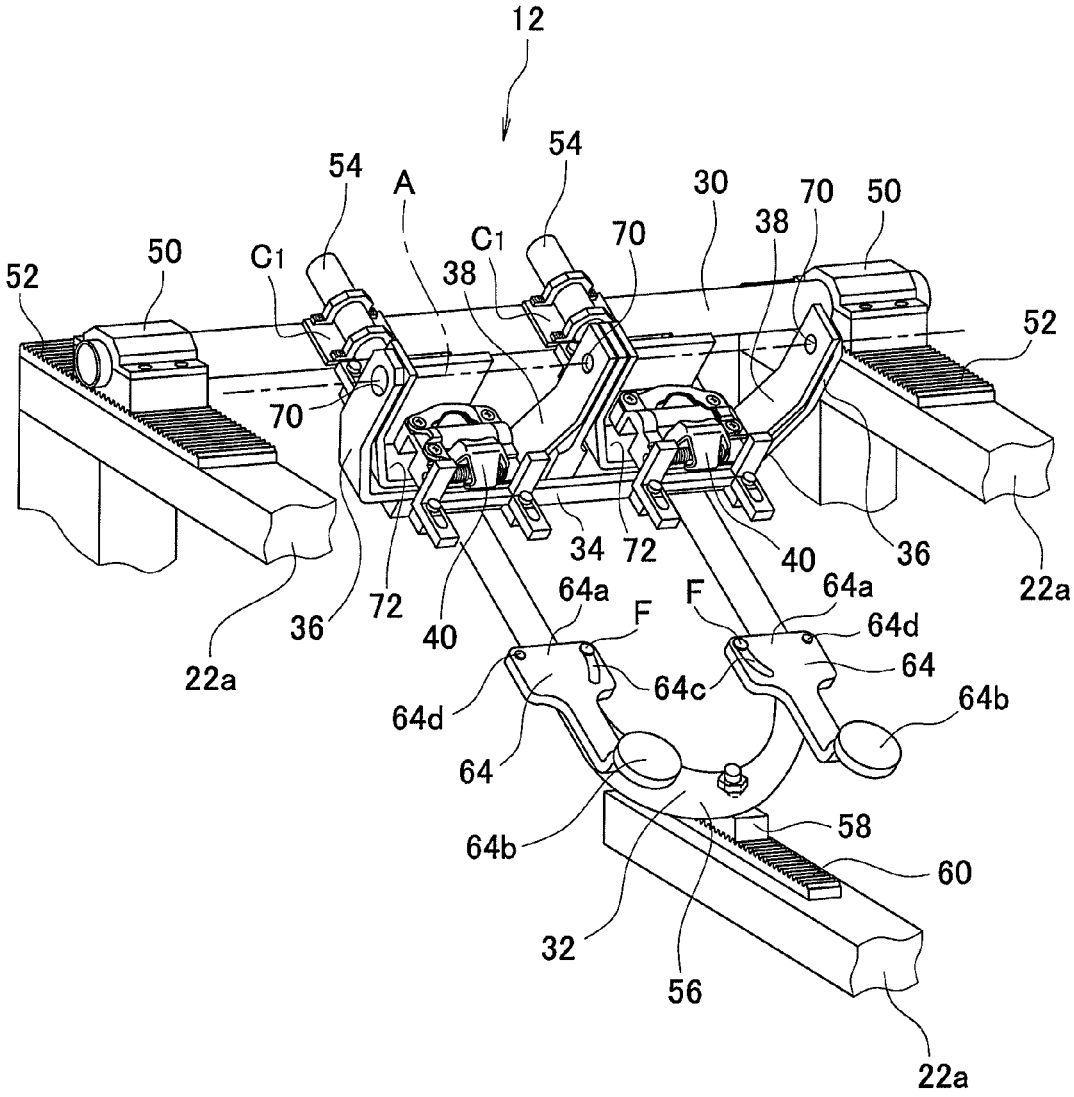
FIG. 2 is a perspective view of the footrest assembly shown removed from the hull of the rowing boat showing a pair of U-shaped footrest members that pivot relative to a support member of the footrest assembly and a pair of shoe contacting surfaces supported on the support member in accordance with the present invention.

As seen in FIGS. 2-5, the third support member 36 swingably support the U-shaped footrest members 38. The third support member 36 is basically a stationary support member that is configured and arranged for coupling to the hull 14 via the support structure 16 (a boat structure). In other words, the third support member 36 is rigidly attached to the second lateral support member 34. The third support member 36 is formed by three upwardly extending supports (i.e., a first end support, a middle support and a second end support with the middle support disposed between the first and second end supports), as shown in FIG. 2. The first and second end supports are connected by a lateral support to form a U-shape stationary support with the middle inwardly extending support being a common support between the U-shaped footrest members 38. A pivot axis A extends through upper ends of the third support member 36. Three pivot pins 70 are used to swingably support the U-shaped footrest members 38. These pivot pins 70 extend through openings in the upper portions of the upwardly extending supports of the third support member 36 coinciding with the pivot axis A. This pivot axis A is located above soles of shoes engaged with the U-shaped footrest members 38.

The U-shaped footrest member 38 includes pivot support ends 71 and a footrest surface 72. The U-shaped footrest member 38 is U-shaped member with the pivot support ends 71 being spaced apart from the footrest surface 72 with the pivot axis A extending through the pivot support ends 71. Consequently, the U-shaped footrest member 38 undergoes pivotal movement about the pivot axis A.

Figure 3:
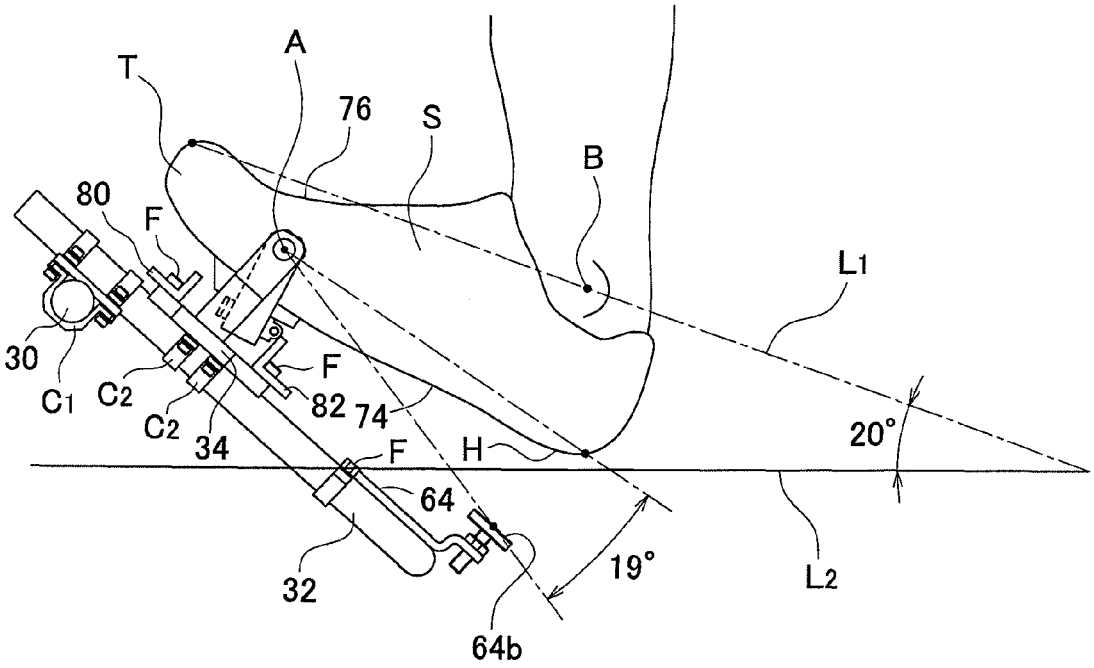
FIG. 3 is a side view of the footrest assembly showing one of the U-shaped footrest members with one of the shoes in the rowing position pivoted to a first pivot position with a heel portion of the shoe pivoted upward and away from the shoe contacting surface during the rowing motion in accordance with the present invention.
Figure 4:
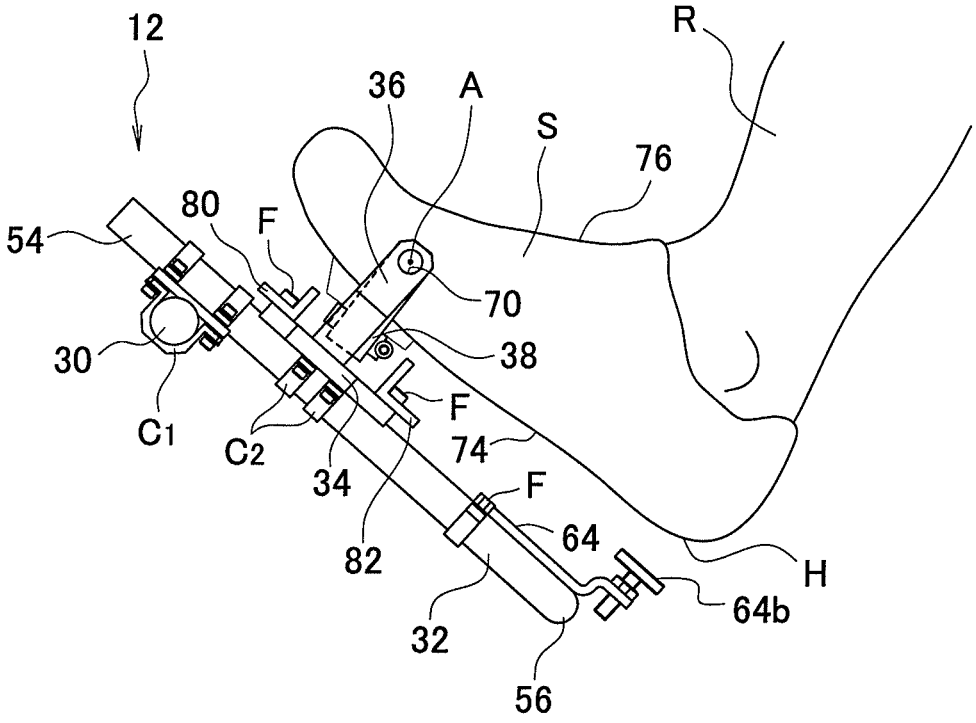
FIG. 4 is another side view of the footrest assembly showing the one of the U-shaped footrest members with the shoe pivoted to an intermediate pivot position such that the heel portion of the shoe is pivoted only part way away from the shoe contacting surface in accordance with the present invention.
Figure 5:
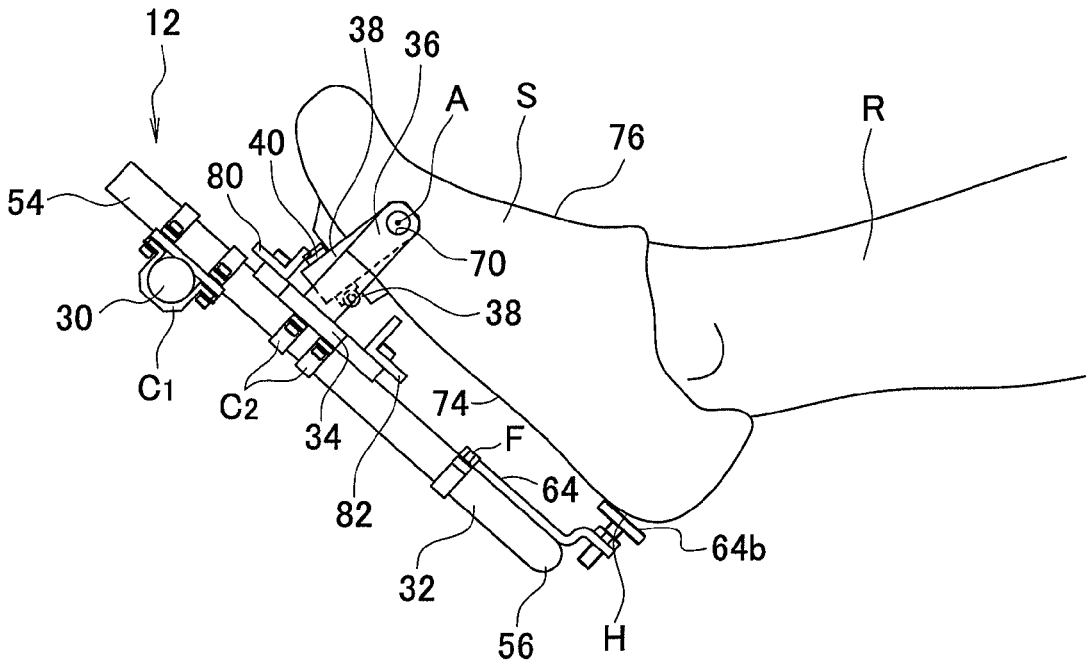
FIG. 5 is still another side view of the footrest assembly showing the one of the U-shaped footrest members with the shoe pivoted such that the heel portion of the shoe contacts the shoe contacting surface in accordance with the present invention.
Figure 6:
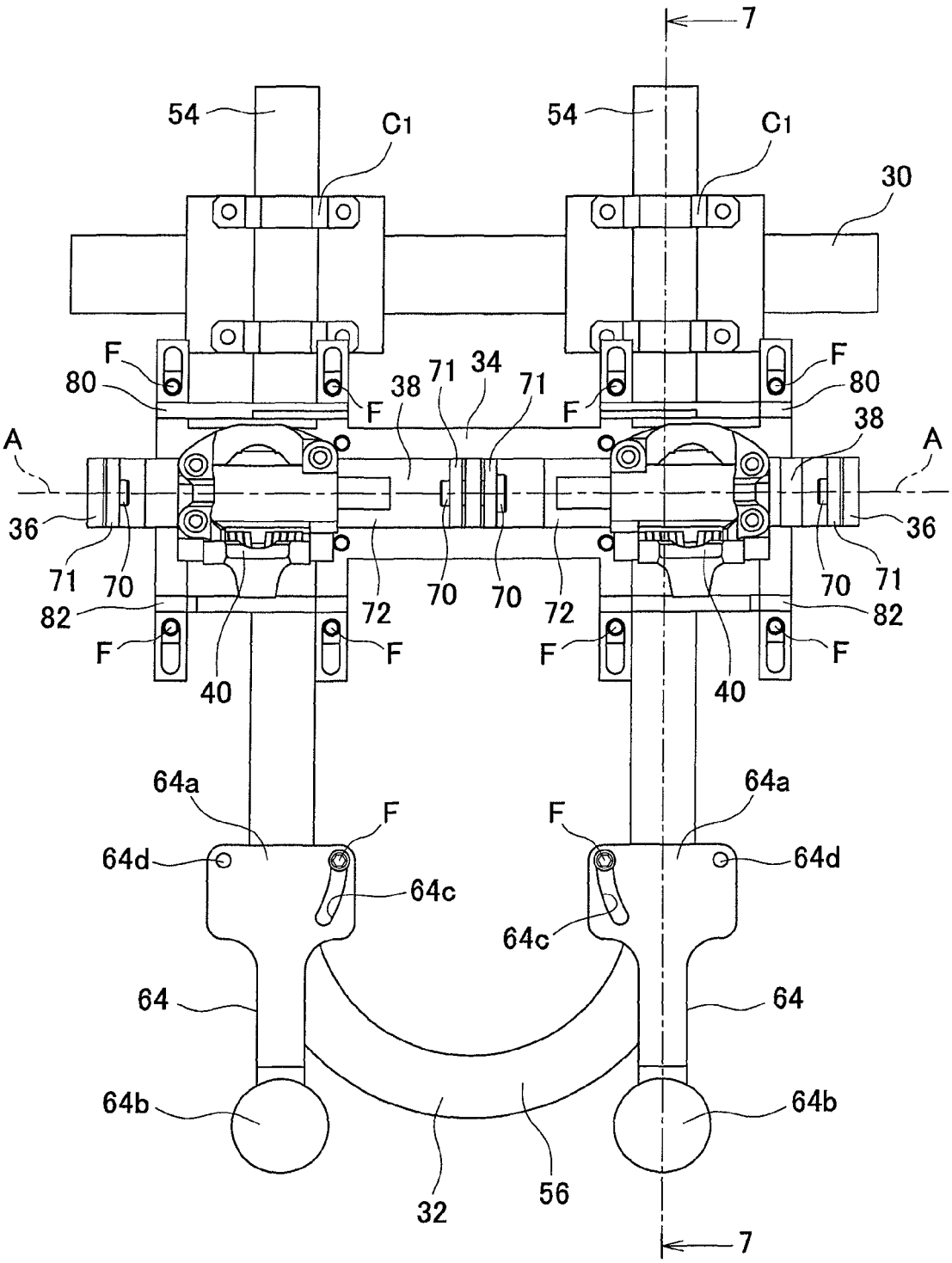
FIG. 6 is a top view of the footrest assembly showing the shoe contacting surface and the U-shaped footrest members in accordance with the present invention.
Figure 7:
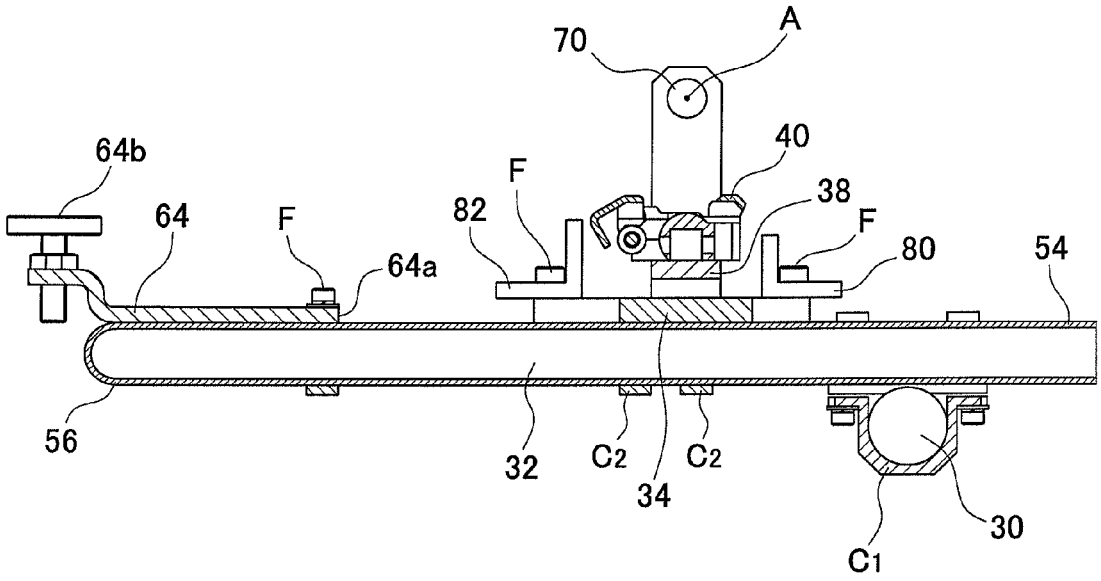
FIG. 7 is a side cross-sectional view of the footrest assembly taken along the line 7-7 in FIG. 6 in accordance with the present invention.
Figure 8:
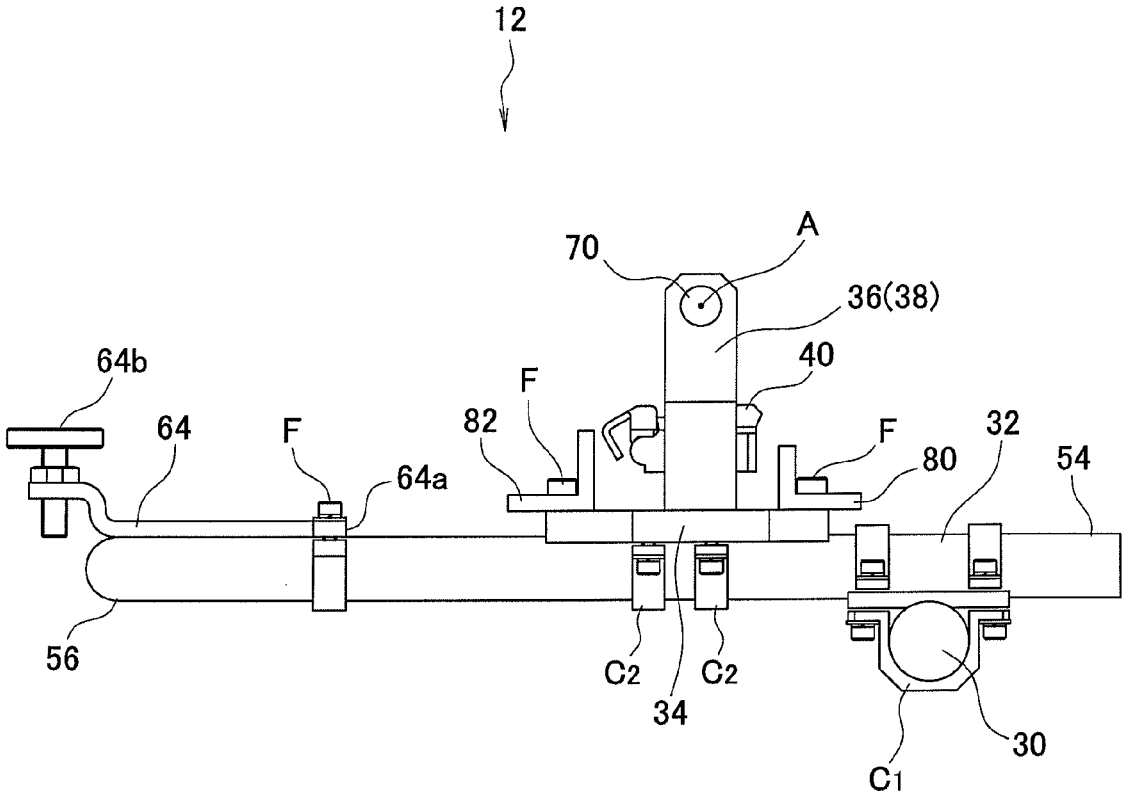
FIG. 8 is a side elevational view of the footrest assembly in accordance with the present invention.

The footrest surface 72 is configured and arranged to support a shoe S (FIGS. 1 and 3-5) such that with the shoe S positioned on the footrest surface 72, the pivot axis A extends laterally through the shoe S between a sole 74 of the shoe and an upper surface 76 of the shoe S, as shown in FIGS. 3-5.

The height of the footrest surface 72 is extended by the inclusion of the shoe attachment portion 40. The shoe attachment portion 40 can be a conventional shoe attachment mechanism such as is used on a bicycle. Specifically, the shoe attachment portion 40 can be a clipless type shoe pedal attachment mechanism, such as those disclosed in, for example, U.S. Pat. No. 6,925,908 and U.S. Pat. No. 6,119,551. In such a clipless type shoe attachment mechanism, the shoe S includes a cleat or attachment member (not shown) that is releasably retained by the shoe attachment portion 40 in a conventional manner.

With the shoe S retained by the shoe attachment portion 40, the pivot axis A extends through the shoe S at a location corresponding to a thumb joint portion of a foot of the rower R with the shoe S in a rowing position depicted in FIGS. 3-5. More specifically, the U-shaped footrest member 38 and the shoe attachment portion 40 are configured such that the pivot axis A extends through the thumb joint of the foot of a rower R. It should be understood from the drawings and the description herein that the thumb joint is also known as the ball of the foot, or in medical terms, the metatarsophalangeal joint.

Having the pivot axis A extend through the thumb joint of the foot of the rower R provides the rower R with an optimal rowing stance. Specifically, as the rower R moves through the rowing motion, the U-shaped footrest member 38 pivots about the pivot axis A in a motion that assists the rower R in optimizing exertion during rowing.

Corresponding to each of the U-shaped footrest members 38, the second lateral support member 34 (the stationary support member) further includes a first or upper side motion limiting portion 80 and a second or lower side motion limiting portion 82. The first motion limiting portion 80 is configured and arranged to limit pivoting movement of the footrest member on an upper side of the second lateral support member 34 when the footrest member is pivoted upwardly with respect to the third support member 36 (e.g., the stationary support member) from a center position. The second motion limiting portion 82 is configured and arranged to limit pivoting movement of the footrest member on a lower side of the second lateral support member 34 when the footrest member is pivoted downwardly with respect to the third support member 36 (e.g., the stationary support member) from the center position. The first and second motion limiting portions 80 and 82 include an adjustment section configured and arranged to adjust the overall angular pivoting movement of the U-shaped footrest member 38.

Specifically, by loosening the fastener F on the first motion limiting portion 80, the first motion limiting portion 80 can be adjustable to contact a portion of the U-shaped footrest member 38, as shown in FIG. 5. Ideally, the rower R adjusts the position of the first motion limiting portion 80 such that clockwise pivoting movement of the U-shaped footrest member 38 is stopped once a heel H of the shoe S contacts the shoe contacting surface 64*b*, as shown in FIG. 5. The clockwise direction is defined relative to the depiction of the U-shaped footrest member 38 in FIGS. 3, 4 and 5.

One function of the first motion limiting portion 80 is to provide a stationary structure to limit movement of the U-shaped footrest member 38 when the rower R steps into the U-shaped footrest member 38 making it easier for the shoe S to be secured to the shoe attachment portion 40.

The second motion limiting portion 82 is adjustable in a similar manner but with different criteria. Specifically, by loosening the fastener F on the second motion limiting portion 82, the rower R can adjust the position of the second motion limiting portion 82 such that counter-clockwise pivoting movement of the U-shaped footrest member 38 is stopped, as shown in FIG. 3. The counter-clockwise direction is defined relative to the depiction of the U-shaped footrest member 38 in FIGS. 3, 4 and 5.

Specifically as shown in FIG. 3, a first line $L_1$ extends from a toe portion T of the shoe S through the ankle B of the rower R. A second line $L_2$ represents horizontal. The rower R adjusts the second motion limiting portion 82 so that his or her shoe S can achieve an angle of approximately 20 degrees measured between the line $L_1$ and the horizontal (line $L_2$). The result is an approximate 19 degree of angular displacement between the sole of the shoe S and the shoe contacting surface 64*b*, as indicated in FIG. 3.

Consequently, the first and second motion limiting portions 80 and 82, allow the rower R to adjust the overall pivoting motion of the shoe S. Such adjustments allow the rower R to limit movement of the shoe S to a specific angular range of movement.

The heel support members 64 also serve as movement stop portion dimensioned for contact with the heel H of the shoe S to limit pivoting movement of the shoe S relative to the pivot axis A with the shoe in a rowing position or orientation on the U-shaped footrest member 38, as shown in FIGS. 3-5.

More specifically, since the U-shaped footrest members 38 are pivotable about the axis A, the shoe S can move with the rower R during the rowing motion. For instance, as shown in FIG. 3, the shoe S and the U-shaped footrest member 38 can pivot such that a heel H of the shoe S pivots upward and away from the shoe contacting surface 64*b*. As indicated in FIG. 3, the second motion limiting portion 82 restricts further upward movement of the heel H. As shown in FIG. 4, the shoe S and the U-shaped footrest member 38 move such that the heel H of the shoe S pivots to an intermediate pivot position such that the heel H of the shoe S is only part way away from the shoe contacting surface 64*b*. In FIG. 5, the shoe S and the U-shaped footrest member 38 move such that the heel H of the shoe S contacts or rests on the shoe contacting surface 64*b*. As indicated in FIG. 5, the first motion limiting portion 82 and the shoe contacting surface 64*b* work together to limit pivoting motion of the shoe S.

The U-shaped footrest assembly 12 can also easily modified for use in other sports related applications. Specifically, the support members 32, the U-shaped footrest members 34 and the shoe attachment portions 40 can be used on skates for speed skating, where a shoe portion of a skate assembly pivots relative to a blade. Such skates used in speed skating are also known as clapskates, slapskates or slap skates.

GENERAL INTERPRETATION OF TERMS

In understanding the scope of the present invention, the term "configured" as used herein to describe a component, section or part of a device that is constructed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "above, downward, vertical, horizontal, below and transverse" as well as any other similar directional terms refer to those directions of a rowing boat equipped with the present invention. Accordingly, these terms, as utilized to describe the present invention should be interpreted relative to a rowing boat equipped with the present invention as used in the normal rowing position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rowing boat footrest assembly comprising:

a stationary support member configured and arranged for coupling to a boat structure with a pivot axis extending through a portion of the stationary support member; and a footrest member having a footrest surface coupled to the stationary support member for pivotal movement about the pivot axis configured and arranged to support a shoe such that with the shoe positioned on the footrest surface the pivot axis extends laterally through the shoe between a sole of the shoe and an upper surface of the shoe, the footrest member being a U-shaped member that includes pivot support ends spaced apart from the footrest surface with the pivot axis extending through the pivot support ends, and the footrest member including a shoe attachment portion configured such that the shoe is releasably securable to the footrest member, the shoe attachment portion being aligned with the pivot axis when viewed perpendicular to the footrest surface.

2. The rowing boat foot support assembly according to claim 1, wherein the pivot axis extends through the shoe at a location corresponding to a thumb joint portion of a foot of a rower with the shoe on the foot rest surface in a rowing position.

3. The rowing boat foot support assembly according to claim 1, wherein the shoe attachment portion includes a bicycle-type clipless pedal mechanism.

4. The rowing boat foot support assembly according to claim 1, wherein the stationary support member includes a motion limiting portion configured and arranged to limit pivoting movement of the footrest member.

5. The rowing boat foot support assembly according to claim 4, wherein the motion limiting portion includes an adjustment section configured and arranged to adjust the overall angular pivoting movement of the footrest member.

6. The rowing boat foot support assembly according to claim 1, wherein the stationary support member includes a movement stop portion dimensioned for contact with a heel portion of the shoe to limit pivoting movement of the shoe relative to the pivot axis with the shoe in a rowing position on the footrest member.

7. A rowing boat footrest assembly comprising:

a stationary support member configured and arranged for coupling to a boat structure with a pivot axis extending through a portion of the stationary support member; and a footrest member having a footrest surface coupled to the stationary support member for pivotal movement about the pivot axis configured and arranged to support a rower's foot such that the footrest surface is located below the pivot axis, the footrest surface and the pivot axis being configured and arranged to support the rower's foot such that with the rower's foot positioned on the footrest surface the pivot axis extends laterally through the rower's foot between a sole of the rower's foot and an upper surface of the rower's foot, the footrest member being a U-shaped member that includes pivot support ends spaced apart from the footrest surface with the pivot axis extending through the pivot support ends.

8. A rowing boat footrest assembly comprising:

a stationary support member configured and arranged for coupling to a boat structure;

a first footrest member pivotally coupled to the stationary support member for pivotal movement about a first pivot axis configured and arranged to support a first shoe such that with the first shoe positioned on the first footrest surface the first pivot axis extends laterally through the first shoe between a sole of the first shoe and an upper surface of the first shoe; and a second footrest member pivotally coupled to the stationary support member for pivotal movement about a second pivot axis configured and arranged to support a second shoe such that with the second shoe positioned on the second footrest surface the second pivot axis extends laterally through the second shoe between a sole of the second shoe and an upper surface of the second shoe, the first and second footrest members being independently pivotal with respect to the stationary support member at locations above soles of shoes engaged with the first and second footrest members, the first footrest member having a U-shaped configuration that includes first upper pivot support ends spaced apart from a first footrest surface with the first pivot axis extending through the first upper pivot support ends, and the second footrest member having a U-shaped configuration that includes second upper pivot support ends spaced apart from a second footrest surface with the second pivot axis extending through the second upper pivot support ends.

9. The rowing boat foot support assembly according to claim 8, wherein the first and second pivot axes are axially aligned.

10. The rowing boat foot support assembly according to claim 8, wherein the stationary support member includes three upwardly extending supports pivotally supporting the first and second upper pivot support ends by a pivot formed on each of the three upwardly extending supports.

11. The rowing boat foot support assembly according to claim 8, wherein the stationary support member includes three upwardly extending supports pivotally supporting the first and second footrest members by three pivots.

12. The rowing boat foot support assembly according to claim 8, wherein each of the first and second footrest members includes a cleat attachment portion that releasably secures a shoe cleat to a respective one of the first and second footrest members.

13. A rowing boat footrest assembly comprising:

a stationary support member configured and arranged for coupling to a boat structure;

a first footrest member pivotally coupled to the stationary support member for pivotal movement about a first pivot axis;

a second footrest member pivotally coupled to the stationary support member for pivotal movement about a second pivot axis;

a first heel support adjustably coupled to the stationary support member at a location rearward of the first footrest member; and a second heel support adjustably coupled to the stationary support member at a location rearward of the second footrest member, the first and second footrest members being pivotal with respect to the stationary support member at locations above sole engagement surfaces of the first and second footrest members, each of the first and second footrest members having a U-shaped configuration that includes upper pivot support ends spaced apart from a footrest surface with the pivot axis extending through the upper pivot support ends.

14. The rowing boat foot support assembly according to claim 13, wherein the first and second pivot axes are axially aligned.

15. The rowing boat foot support assembly according to claim 13, wherein each of the first and second footrest members includes a cleat attachment portion that releasably secures a shoe cleat to a respective one of the first and second footrest members.

16. A rowing boat footrest assembly comprising:

a stationary support member configured and arranged for coupling to a boat structure;

a footrest member pivotally coupled to the stationary support member for pivotal movement about a first pivot axis; and a first side motion limiting portion arranged to limit first side pivotal movement of the footrest member when the footrest member is pivoted in a first direction with respect to the stationary support member from a center position, the footrest member being pivotal with respect to the stationary support member at a location above a sole engagement surface of the footrest member, the footrest member being a U-shaped member that includes pivot support ends spaced apart from the footrest surface with the pivot axis extending through the pivot support ends.

17. The rowing boat foot support assembly according to claim 16, further comprising a second side motion limiting portion arranged to limit second side pivotal movement of the footrest member when the footrest member is pivoted in a second direction that is different from the first direction with respect to the stationary support member from the center position.

18. The rowing boat foot support assembly according to claim 16, wherein the footrest member includes a cleat attachment portion that releasably secures a shoe cleat to the footrest member.

* * * * *